US005317369A

United States Patent [19]

Nakanishi

[11] Patent Number: 5,317,369

[45] Date of Patent: May 31, 1994

[54] APPARATUS FOR DETECTING TONER IN IMAGE FORMING APPARATUS

[75] Inventor: Keiichi Nakanishi, Nagaokakyo, Japan

[73] Assignee: Murata Kikai Kabushiki Kaisha, Kyoto, Japan

[21] Appl. No.: 946,959

[22] Filed: Sep. 17, 1992

[30] Foreign Application Priority Data

Sep. 26, 1991 [JP] Japan ..... 3-247965

[51] Int. Cl.[5] ..... G03G 15/08

[52] U.S. Cl. ..... 355/208; 118/691; 355/246

[58] Field of Search ..... 355/246, 245, 208, 203, 355/204, 205, 206; 118/689, 691, 690

[56] References Cited

U.S. PATENT DOCUMENTS 4,758,861 7/1988 Nakamaru et al. ..... 118/691 X
5,075,726 12/1991 Itaya et al. ..... 355/246
5,160,968 11/1992 Yamada et al. ..... 355/208
5,162,874 11/1992 Butler ..... 356/446
5,166,729 11/1992 Rathbun et al. ..... 355/208

*Primary Examiner*—A. T. Grimley
*Assistant Examiner*—T. A. Dang
*Attorney, Agent, or Firm*—Spensley Horn Jubas & Lubitz

[57] ABSTRACT

An apparatus for detecting an amount of toner in a toner casing. A sensor detects the magnetic flux density of the toner in the toner casing and generates detection signals. A sampling device samples the detection signals. A selecting device selects a signal having the lowest value among the sampled signals. A device for setting up a threshold value determines the threshold value using the selected signal. A counting device counts the number of sampled signals lower than the threshold value. If the counted number is larger than a predetermined value, then an indicator lamp indicates that toner is lacking.

15 Claims, 4 Drawing Sheets

APPARATUS FOR DETECTING TONER IN IMAGE FORMING APPARATUS

BACKGROUND OF THE INVENTION

1. Technical Field

The present invention relates to an apparatus for detecting a toner inside a developing device of an image forming apparatus, whereby an operator can know an amount of remaining toner.

2. Background Art

Conventionally, a toner detecting apparatus includes a sensor, which is provided in a casing of a developing device, to detect a toner inside the developing device. An output signal (voltage) from the sensor is compared with a predetermined fixed threshold value and the amount of toner is indicated based on the comparison result.

However, since a toner agitator is provided in the developing device casing and the toner is often agitated by this agitator, the output voltage from the sensor is influenced by the agitation. Therefore, the output voltage from the sensor substantially always fluctuates and a precise amount of toner cannot be grasped. Further, the output value of the sensor drifts with its own temperature so that the comparison result varies, even if the amount of toner does not change. Consequently, an exact amount of toner cannot be detected.

SUMMARY OF THE INVENTION

The present invention is developed to eliminate the above-described problems and its primary object is to provide an apparatus for detecting an exact amount of toner even if the toner is being agitated and/or the sensor temperature changes, whereby an exact amount of remaining toner can be known.

To achieve this object, the present invention provides an apparatus for precisely detecting an amount of toner in a developing device casing. The toner detecting apparatus is useful to an image forming apparatus having a toner agitator which stirs the toner inside the developing device casing. The toner detecting apparatus comprises: a sensor for detecting the change of magnetic flux density, the magnetic flux density varying with the amount of toner; means for sampling output signals from the sensor at predetermined intervals; means for setting up a threshold value using the sampled signals; and means for counting the number of sampled signals which are not equal to the threshold value to determine the amount of toner in the casing.

According to the present invention, the sensor detects the change of the magnetic flux which varies with the amount of toner inside the developing device casing, and the sampling means samples the signals output from the sensor at the predetermined constant intervals. Then, a threshold value is determined using the sampled signals by the setting up means. The number of the sampling signals which are not equal to the threshold value is counted by the counting means to determine the amount of toner. Therefore, the threshold value is not always constant, but the threshold value is determined using the sampled data. Further, the amount of toner is not simply determined by the voltage output from the sensor, but determined by counting the number of the sampled data which are not equal to the threshold value. Accordingly, it is possible to precisely detect the amount of toner, regardless of the agitation by the toner agitator and/or the drift of the sensor output due to the change of the sensor temperature.

This and other aspects, objects and advantages of the present invention will become more apparent from a following detailed description as read with the accompanying drawings and appended claims.

DESCRIPTION OF THE PREFERRED EMBODIMENTS

Now, a preferred embodiment of the present invention will be described in reference to the accompanying drawings.

Figure 2:
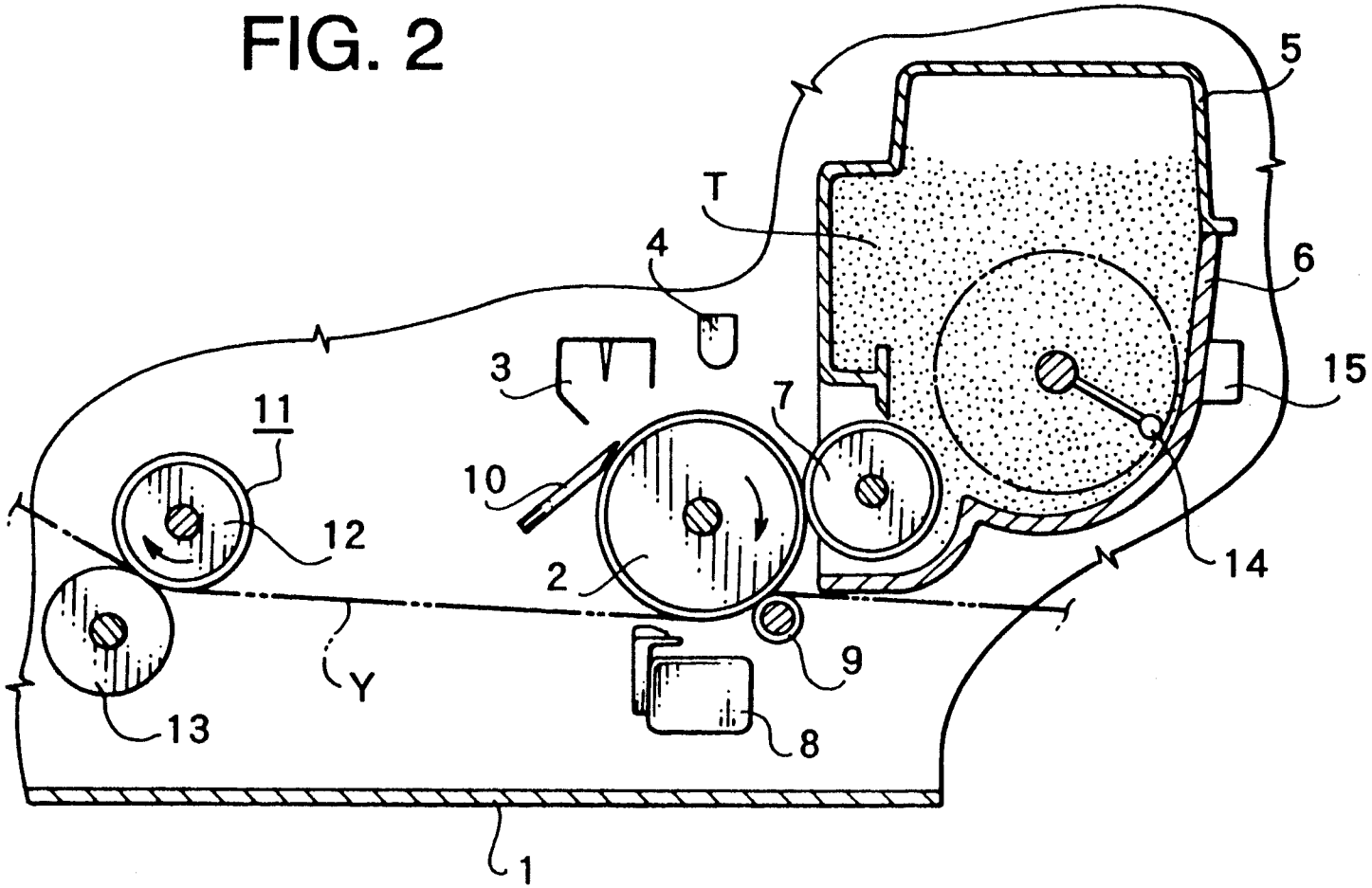
FIG. 2 is a partial sectional view of the image forming apparatus of FIG. 1.

First referring to FIG. 2, a photosensitive drum 2 is provided on a sheet conveyance passage inside a housing 1 of an image forming apparatus. An electric charger 3 is provided to uniformly charge an outer surface of the photosensitive drum 2 at a predetermined voltage (−700 V in this embodiment). An exposing device 4 irradiates a beam to form an electrostatic latent image of predetermined voltage (−100 V in this embodiment) on the photosensitive drum 2. A developing device 5 includes a toner casing 6 for accommodating a toner T, and a developing roller 7. The developing roller 7 provides the toner T with a predetermined voltage (−450 V in this embodiment). The voltage difference between the toner voltage (−450 V) and the electrostatic latent image voltage (−100 V) causes the toner T to adhere on the electrostatic latent image so that the electrostatic latent image is visualized.

A transfer unit 8 and a guide roller 9 are provided below the photosensitive drum 2 and the sheet conveyance passage extends between these two elements 8, 9 and the photosensitive drum 2. The guide roller 9 presses the sheet Y against the photosensitive drum 2, and the transfer unit 8 applies a predetermined voltage (+100 V in this embodiment) to that part of the sheet which adheres on the photosensitive drum 2. The voltage difference between +100 V and the toner image voltage (−450 V) causes the toner image to transfer onto the sheet Y. A cleaner 10 scrapes the remaining toner off the photosensitive drum 2.

A heat-fixing device 11, which serves as an image fixing device, is provided inside the image forming apparatus housing 1 and includes a heat roller 12 and a press roller 13. The heat roller 12 and the press roller 13 face each other over the sheet conveyance passage. The sheet conveyance passage extends between these two rollers 12 and 13 so that the toner image on the sheet Y is heat-fixed.

Figure 1:
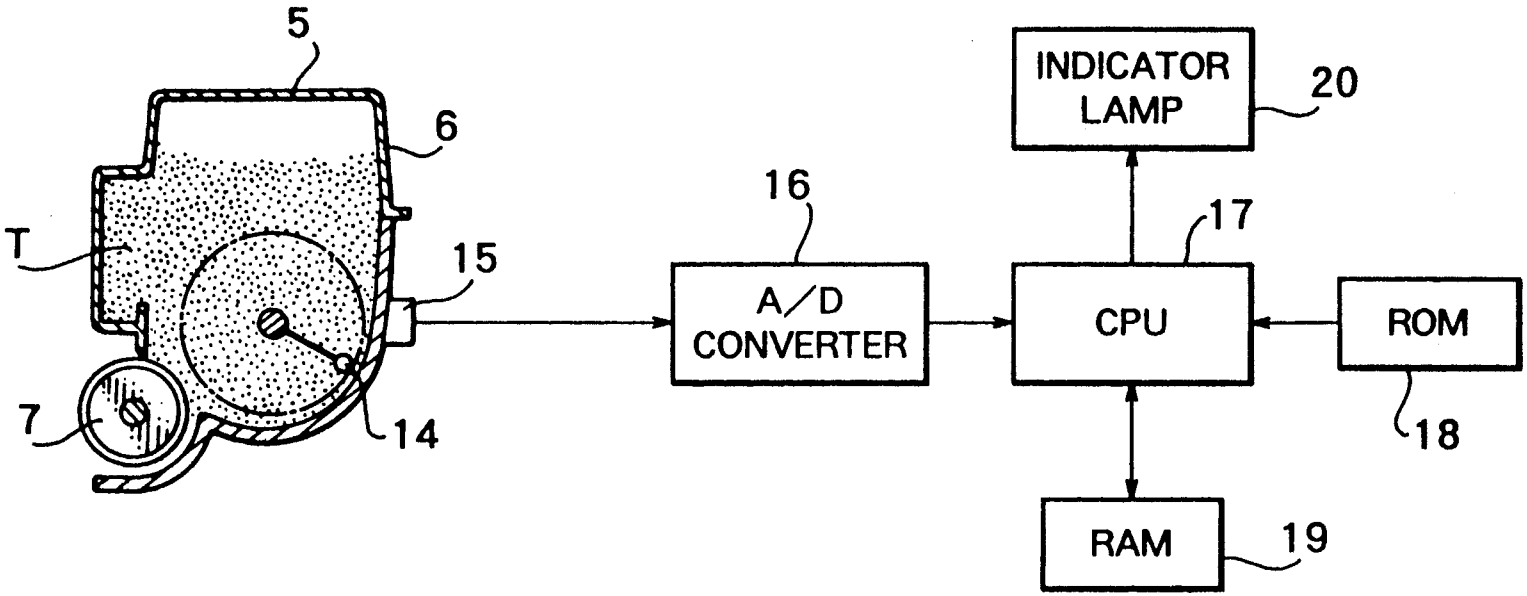
FIG. 1 is a block diagram showing a circuitry used with an image forming apparatus for detecting an amount of toner.

As shown in FIGS. 1 and 2, an agitator 14 is rotatably supported in the toner casing 6 of the developing device 5. As the agitator 14 rotates, the toner T is stirred in the toner casing 6 so that the toner T in the toner casing 6 is always kept at a uniform density and never becomes a lump. A period of one rotation of the agitator 14 is about three seconds. A sensor 15 is detachably mounted on an outer face of the toner casing 6 such that the sensor 15 can detect a magnetic flux density of the toner T in the toner casing 6. A detection signal (voltage) Va, which corresponds to the magnetic flux density, is output to an A/D converter 16 from the sensor 15. The signal Va is an analog signal and A/D converted to a digital signal Vd by the A/D converter 16. The digital signal Vd is sent to a CPU 17.

The CPU 17 controls an overall operation of the apparatus on a program stored in a ROM 18. The CPU 17 and the ROM 18 constitute sampling means, setting up means, and counting and determining means. The digitized signals Vd are sampled at constant intervals on the program stored in the ROM 18. This sampling is performed three hundred times while the agitator 14 rotates 360 degrees, i.e., at a rate of about 300 times/3 seconds. A data having the lowest value among these 300 data is selected and a predetermined value is added thereto. The resultant is taken as a threshold value Vref. In other words, if the sampling data having the lowest value is represented by Vd1 and the predetermined value is represented by a, the threshold value Vref can be expressed by a following equation:

$$Vref = Vd1 + a$$

Then, the CPU 17 counts the number of the sampling data which are smaller than the threshold value Vref to determine if the toner is lacking. Specifically, if this number is larger than a predetermined value, the CPU 17 judges that the toner is lacking. A RAM 19 temporarily stores the sampling data and the threshold value Vref. An indicator lamp 20 is provided to indicate by its lighting that the CPU 17 judges that the toner is lacking.

Next, the operation of the toner detecting apparatus used for the image forming apparatus will be explained.

Figure 3:
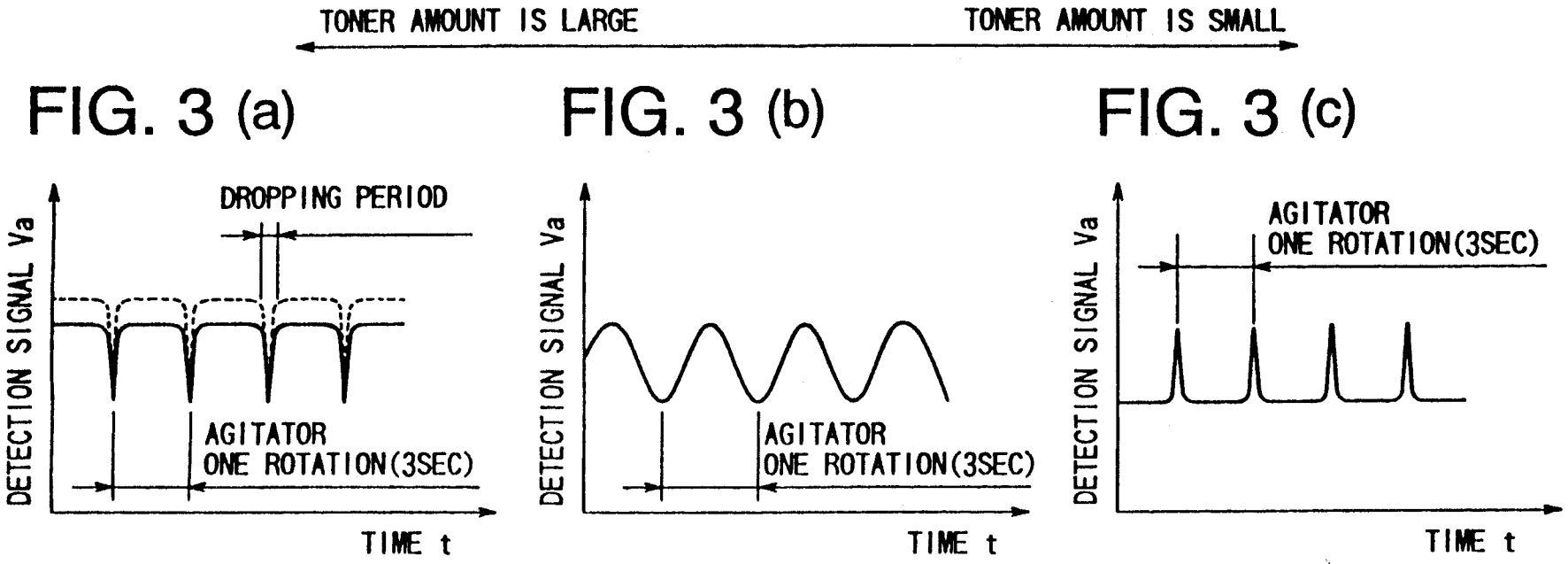
FIGS. 3(*a*)-3(*c*) are a set of views showing signals detected by a sensor, respectively.

When the magnetic flux density of the toner T inside the toner casing 6 is detected by the sensor 15, the detection signal (voltage) Va which corresponds to the magnetic flux density is output from the sensor 15, as shown in FIG. 3. It should be noted here that the toner T inside the toner casing 6 is always agitated by the agitator 14 and the level of the detection signal Va from the sensor 15 always fluctuates. The period of fluctuation is the same as the period of rotation of the agitator 14 (about 3 seconds). If there is enough toner T in the casing 6, the dropping period of the detection signal Va is small, as shown in FIG. 3(*a*). As the amount of toner T decreases, the dropping period becomes larger, as illustrated in FIGS. 3(*b*) and 3(*c*).

Figure 4:
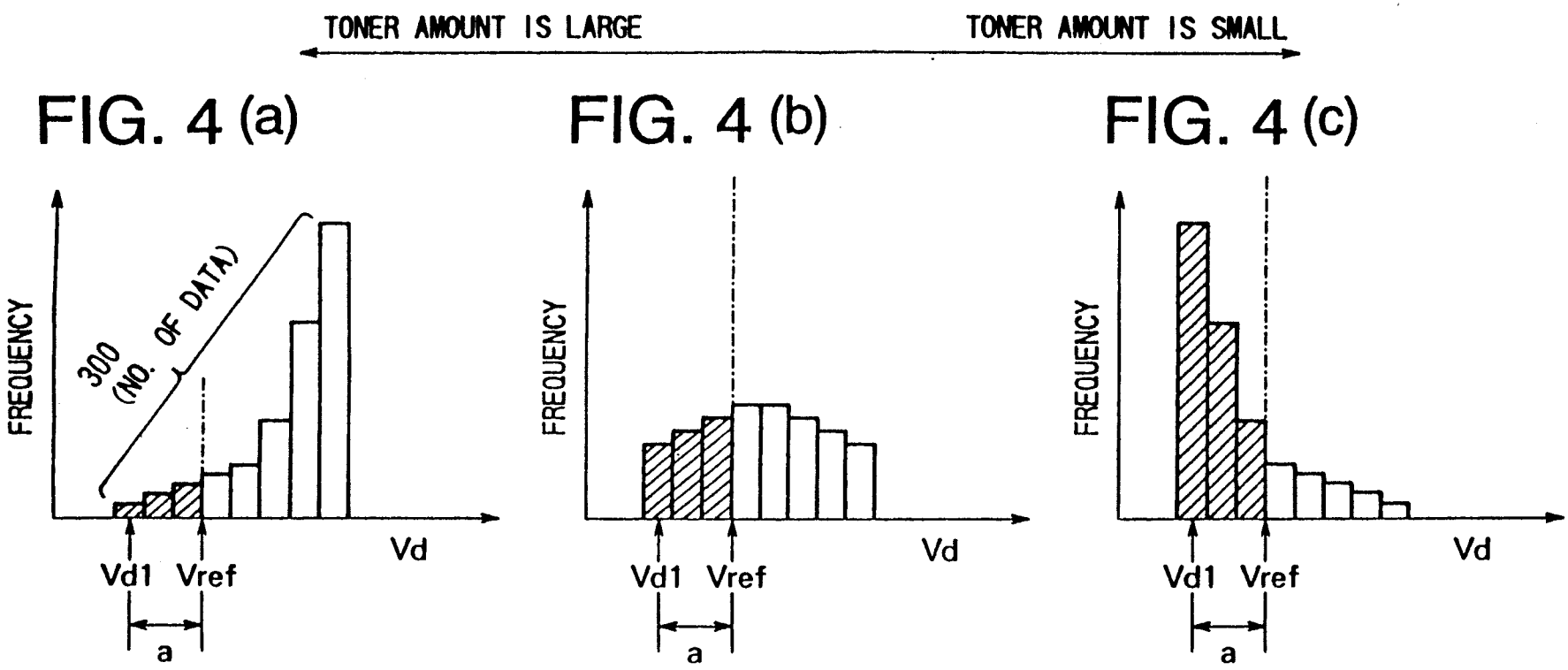
FIGS. 4(*a*)-4(*c*) are a set of views showing frequency distributions of sampling data, respectively.

The signal Va from the sensor 15 is A/D converted by the converter 16 and the digitized data Vd is output to the CPU 17 from the converter 16. In the CPU 17, the digitized data Vd are sampled at every 10 milliseconds (or at the rate of 300 times/3 seconds). (3 seconds is a time for one rotation of the agitator 14.) Frequency distributions of these 300 sampling data are depicted in FIG. 4. Specifically, if a large amount of toner T remains in the casing 6, the number of low-level sampling data is small (hatched portion), as shown in FIG. 4(*a*). As the amount of toner T inside the casing 6 decreases, the number of low-level sampling data (hatched portion) increases, as shown in FIGS. 4(*b*) and 4(*c*).

As seen in FIG. 4, the predetermined value a is added to the lowest value Vd1 to obtain the threshold value Vref. Then, the number of the data which are lower than the threshold value Vref is counted. Whether the amount of toner inside the toner casing 6 is lacking or not is determined by comparing the number of these data with a predetermined value. Specifically, if the number of such data is greater than the predetermined value, the amount of toner inside the toner casing 6 is considered lacking. For example, if the total number of the sampling data lower the threshold value is smaller than the predetermined value, as shown in FIG. 4(*a*), the amount of toner T is judged large. On the other hand, if the total number of the sampling data lower than the threshold value Vref is larger than the predetermined value, as shown in FIGS. 4(*b*) and 4(*c*), the amount of toner T is considered small. When the total number of the sampling data lower than the threshold value is larger than the predetermined value, the amount of toner T inside the casing 6 is judged lacking so that the indicator lamp 20 is turned on to indicate this.

As described above, the signals from the sensor 15 are sampled and the threshold value is determined using one of the sampled data, i.e., the one having the lowest value. The amount of toner T is judged from the total number of those sampling data having values lower than the threshold value. Therefore, even if the toner T is agitated in the toner casing 6 and the signals from the sensor 15 fluctuates, the amount of toner T can be grasped precisely regardless of such a fluctuation.

The threshold value is set up based on the lowest value among the sampling data (or data from the sensor 15). Thus, even if the level of the signals from the sensor 15 changes, as indicated by the broken line in FIG. 3(*a*), the threshold value also changes with such change of the signal level. Accordingly, the amount of toner T can be precisely grasped regardless of the change of the sensor temperature.

Since the sensor 15 is detachably mounted on the outer face of the toner casing 6, the sensor 15 will be removed from the toner casing 6 as desired. Specifically, when the amount of toner in the toner casing 6 is lacking and the toner casing 6 is exchanged for new one, the sensor 15 is detached from the casing 6 and attached to new casing. This results in a cost reduction.

It should be noted that the present invention is not limited to the illustrated embodiment. For instance, the number of the data having a value lower than the threshold value is counted in the embodiment, but the number of the data having a value higher than the threshold value may be counted to judge if the amount of toner is lacking.

We claim:

1. An apparatus for detecting an amount of toner in a developing device casing, the apparatus used for an image forming apparatus having a rotatable toner agitator which stirs the toner inside the developing device casing, the apparatus comprising a sensor for detecting the change of magnetic flux density, the magnetic flux density varying with the amount of toner;

means for sampling signals output from the sensor a plurality of times at substantially constant predetermined intervals while the agitator rotates approximately 360°;

means for setting up a threshold value using the plurality of sampled signals, the means for setting up a threshold value comprising means for selecting the data sample having the lowest value among the plurality of sampled signals and adding a predetermined value to the data sample having the lowest value; and means for counting the number of sampled signals which are not equal to the threshold value amount of toner in the casing.

2. The apparatus of claim 1, further including means for agitating the toner such that the toner is substantially always stirred and kept at a uniform density.

3. The apparatus of claim 1, wherein the sensor is detachably mounted on an outer face of the toner casing.

4. The apparatus of claim 1, wherein the signal from the sensor is an analog signal, and the apparatus further includes an A/D converter for converting the analog signal to a digital signal such that the sampling means samples the digital signal.

5. An apparatus for detecting an amount of toner in a developing device casing, the apparatus used for an image forming apparatus having a toner agitator which stirs the toner inside the developing device casing, the apparatus comprising a sensor for detecting the change of magnetic flux density, the magnetic flux density varying with the amount of toner means for sampling signals output from the sensor at predetermined intervals; means for setting up a threshold value using the sampled signals; and means for counting the number of sampled signals which are not equal to the threshold value amount of toner in the casing, wherein the sampling means samples the signals three hundred times in three seconds.

6. The apparatus of claim 5, wherein a period of one rotation of the agitator is about three seconds.

7. The apparatus of claim 1, further including means for storing the sampling signals and the threshold value.

8. The apparatus of claim 1, further including a lamp for indicating that the toner is lacking, if the amount of toner is smaller than a predetermined volume.

9. A method of detecting an amount of toner in a toner casing, comprising the steps of:

(A) detecting the magnetic flux density of the toner in the toner casing to generate a detection signal;

(B) sampling the detection signals;

(C) selecting a signal having the lowest value among the sampled signals;

(D) setting up a threshold value using the selected signal;

(E) counting the number of sampled signals lower than the threshold value; and (F) indicating that the toner is lacking, if the counted number is larger than a first predetermined value.

10. The method of claim 9, wherein the sampling is performed three hundred times in three seconds.

11. The method of claim 9, wherein the step (D) includes adding the selected signal and a second predetermined value.

12. The method of claim 9, further including the step of agitating the toner before the step (A) such that the toner is substantially always stirred and kept at a uniform density.

13. The method of claim 12, wherein a period of the agitation is about three seconds.

14. The method of claim 9, wherein the detection signal an analog signal, and the method further includes the step of converting the analog signal to a digital signal such that the sampled signal are the digital signal.

15. The method of claim 9, wherein the step (F) includes the step of lighting an indicator lamp.

* * * * *